United States Patent [19]

Fastenau

[11] 4,037,979

[45] July 26, 1977

[54] ANCHORING ARRANGEMENT, ESPECIALLY FOR PRE-STRESSED CONCRETE CONSTRUCTIONS

[75] Inventor: Werner Fastenau, Esslingen-Rudern, Germany

[73] Assignee: Ed. Züblin Aktiengesellschaft, Stuttgart, Germany

[21] Appl. No.: 571,207

[22] Filed: Apr. 24, 1975

[30] Foreign Application Priority Data

Apr. 24, 1974 Germany ..... 2419628

[51] Int. Cl.[2] ..... B25G 3/28

[52] U.S. Cl. ..... 403/284; 403/373; 52/230

[58] Field of Search ..... 403/266, 267, 268, 300, 403/305, 314, 361, 373, 374, 284, 285, 372; 285/367, 369; 52/223, 230

[56] References Cited

U.S. PATENT DOCUMENTS

| | | | |
|---|---|---|---|
| 428,123 | 5/1890 | Morrison | 403/314 |
| 831,548 | 9/1906 | Fleeger | 403/314 |
| 2,576,528 | 11/1951 | Matthysse | 403/305 X |
| 2,666,590 | 1/1954 | Pryor | 403/361 X |
| 2,934,935 | 5/1960 | Zerna et al. | 403/266 X |
| 3,325,195 | 6/1967 | Margis | 285/369 X |
| 3,501,178 | 3/1970 | Watts | 403/305 X |
| 3,552,787 | 1/1971 | Yee | 403/268 X |

FOREIGN PATENT DOCUMENTS

| | | | |
|---|---|---|---|
| 525,323 | 5/1931 | Germany | 403/266 |

*Primary Examiner*—Wayne L. Shedd
*Attorney, Agent, or Firm*—Walter Becker

[57] ABSTRACT

An anchoring arrangement, especially for pre-stressed concrete constructions, for anchoring reinforcing means in the form of ropes, cables, wires and rods, by means of a sleeve and an intermediate layer arranged within the sleeve and defining an axially extending hollow space substantially filled by the reinforcing means to be anchored. The intermediate layer which tightly engages the sleeve and the reinforcing means comprises granular material and a binding substance therefor, while the intermediate layer is harder than the reinforcing means.

5 Claims, 8 Drawing Figures

Fig.1
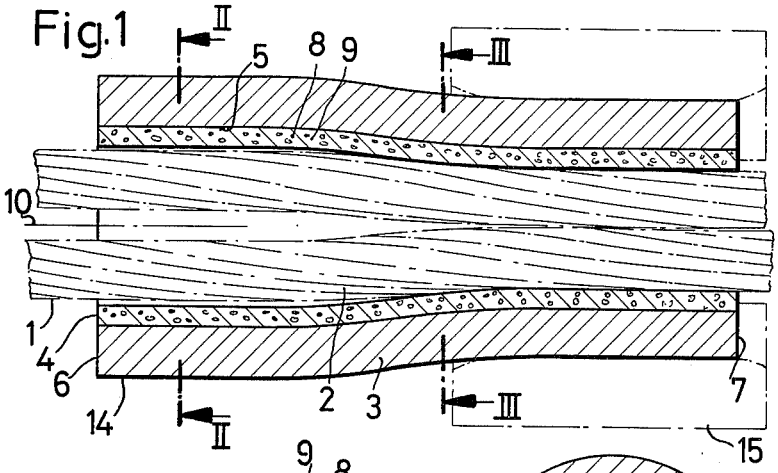
Fig.3
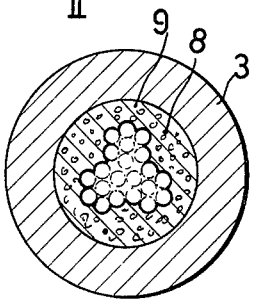
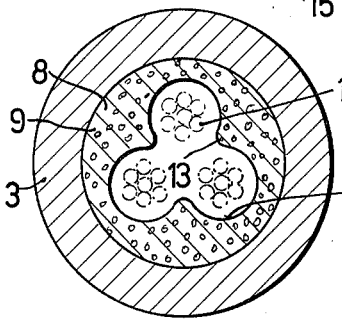
Fig.2
Fig.5
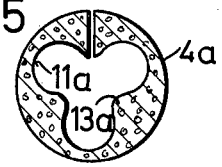
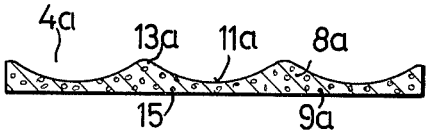
Fig.4
Fig.7
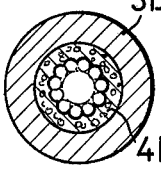
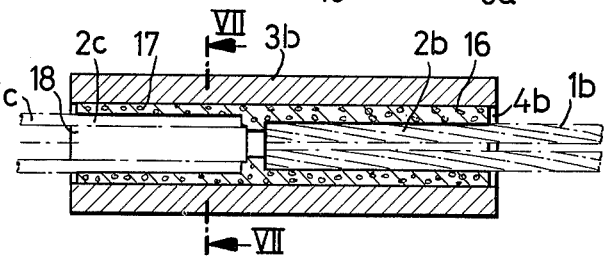
Fig.6
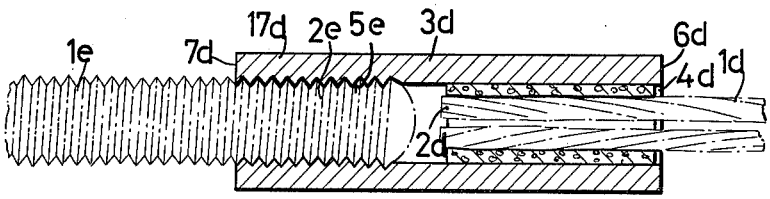
Fig.8

ANCHORING ARRANGEMENT, ESPECIALLY FOR PRE-STRESSED CONCRETE CONSTRUCTIONS

The present invention relates to an anchoring member, particularly for use with stressed concrete constructions for the anchoring of smooth wire cable or rod reinforcing elements, of the kind having a sleeve and an insert disposed in a hollow space between the sleeve and a reinforcing element, the insert being harder than the reinforcing element.

With a known form of anchoring member the insert is formed by a toothed wedge which is pressed onto the reinforcing element with a force which is so great that the teeth of the wedge bite into the surface of the reinforcing element. This gives rise to a comparatively large amount of damage to the surface of the reinforcing element which entails a reduction of the static and in particular the dynamic tensile strength. The drop in strength is indeed comparatively small with reinforcing elements with larger cross-section faces but reaches such a high value with strand-like reinforcing elements which are made from small caliber wires that it is questionable as to whether it is economical to use anchoring members with stressed concrete constructions. With regard to manufacturing tolerances with this anchoring there is encountered the drawback that only a few teeth of the wedge are pressed comparatively deeply into the reinforcing element so that high specific stresses result.

It is also known to anchor reinforcing elements by compression at the end. This way of anchoring leads to a reduction in the oscillating resistance and is with cable-like reinforcing elements not possible.

Furthermore it is known to embed members in concrete with adhesion although because of the reduction in cross-section the attainment of adequate friction is problematic and requires large adhering lengths or an increase in the friction, for example by means of corrugation. For a so-called coupling anchoring, that is an anchoring of a coupling end to which a free coupling is to be made, an adhering anchoring by emdedding in concrete is not suitable.

For the anchoring as well as for the formation of abutting connections of reinforcing elements that are not smooth surfaced, it is known to provide a sleeve made of soft steel which for producing a positive connection with the reinforcing elements is cold formed by the application of large radial forces. The sleeve is formed by the action of the radial forces in such a way that it is pressed closely onto the reinforcing element while the ribs of the harder reinforcing element are stamped into the soft steel of the sleeve. By means of this method the anchoring of smooth reinforcing elements is, however, not possible as in this case only a frictional connection can be achieved. The smooth reinforcing elements in stressed concrete constructions are as a rule rolled or drawn rods, wires or strands made into cables from several, for the most part seven, drawn wires. These reinforcing elements have a very high tensile strength and are therefore also subjected to correspondingly high stresses. These are, however, extraordinarily sensitive to damages of the surfaces, for example by grooving.

It is, therefore, an object of the present invention to provide an anchoring system which will assure an anchoring arrangement of high strength, in particular with smooth surfaced reinforcing elements, with short anchoring length and with as little damage as possible being caused to the surface of the reinforcing elements.

These and other objects and advantages of the invention will appear more clearly from the following specification in connection with the accompanying drawings, in which:

FIG. 1 is an axial section of one form of an anchoring member according to the invention.

FIG. 2 is a section on line II—II of FIG. 1.

FIG. 3 is a section on line III—III of FIG. 1.

FIG. 4 shows a further embodiment of an intermediate part or insert in a pre-prepared state.

FIG. 5 shows the intermediate layer according to FIG. 4 in the mounted state.

FIG. 6 is an axial section of a further embodiment of an anchoring member.

FIG. 7 is a section on the line VII—VII of FIG. 6.

FIG. 8 is an axial section of a further embodiment of an anchoring member.

The anchoring system according to the present invention is characterized primarily in that the intermediate layer is provided in the form of a granular material the granules of which are densely compacted in a bond or compound and together therewith substantially fill the said hollow space. The sleeve is in a manner known per se formed from soft steel or the like as a deformable sleeve which can be constricted by radial cold forming. With cold forming or shaping of the sleeve by application of large radial forces, the granular material is substantially varied in its position so that all hollow spaces between the reinforcing elements and the sleeve wall are completely filled and finally the hard granules which are only displaced but are not deformed are themselves pressed into the contact faces in the surface of the reinforcing element and in the inner face of the sleeve. In this way, an intimate interengagement of the granules among each other and with the reinforcing element as well as with the sleeve is realized so that large forces acting on the reinforcing element can be transmitted to the sleeve. Inasmuch as the granules act as a plurality of small teeth, there results only extremely small damages to the surface of the reinforcing element and of the anchoring member and also only small specific surface stresses so that the static and in particular and dynamic strength of the reinforcing element is not substantially reduced. The granules combine in almost uniform distribution over the whole anchoring length and over the whole periphery of the anchored section with the reinforcing elements so that a very uniform distribution of the stresses occurring can be insured. This is even the case when bundles of reinforcing elements are jointly anchored since also in this case not only a linear but also a planar transmission of force acting over a comparatively large part of the periphery of the reinforcing element takes place. By suitable choice of the magnitude and the shape of the granules, the clamping member anchoring can be adapted to all requirements.

Due to the action of the binder, the granules are firmly held in a predetermined position before the constriction of the deformable sleeve so that the reinforcing element can be introduced very easily into the anchoring member. If no binding is provided then generally the granular material must be introduced into the hollow space between the sleeve and the reinforcing element, after the introduction of the reinforcing element into the sleeve and after closing of at least one end of the sleeve.

Referring now to the drawing in detail, FIGS. 1 to 3 show an anchoring system for anchoring the ends 2 of reinforcing elements 1, which has a comparatively thick-walled sleeve 3 the wall thickness of which may correspond approximately to the diameter of the reinforcing elements, and which has in the initial state, in a simple manner, constant cross-sections over its length and is in particular cylindrical so that it may be formed by a tube section. The sleeve 3 is formed from a material which is deformable in the cold and can maintain a stable shape in the deformed state, for example soft steel, and may have a length which is only slightly greater than twice its outer diameter in the initial, undeformed, state.

In the sleeve 3 there is disposed an intermediate layer or insert 4 which over it entire surface engages the cylindrical inner face 5 of the sleeve 3 and extends up to the two end faces 6, 7 of the sleeve 3. The intermediate layer 4 has portions of different thickness, and in the thinnest region may be thinner and in the thickest region thicker than the wall thickness of the sleeve 3. The layer 4 consists of a granular material 8 as densely compacted as possible and a binding medium 9 in which the granular material 8 is embedded. Expediently, the granules of the granular material 8 are arranged so densely that they contact each other already in the initial state of the sleeve 3 and of the pre-stressing element and thus interengage each other in the manner of teeth. Furthermore, the granules are arranged in uniform density over the whole length of the intermediate layer 4 as well as over its periphery. The granules of the granular material 8 may in a simple manner consist of steel the hardness of which is greater than the hardness of the material of the reinforcing elements 1 and of the material of the sleeve 3. The granules of the granular material 8 also is the initial state of the sleeve 3 suitably extend as far as the inner face 5 of the sleeve as well as as far as the inner face of the intermediate member 4.

The binding medium consists of a material such as plastics, cement or the like and fills the hollow spaces between the granular material substantially completely. The binding may be flexible and elastic or in particular in the case of cement may be comparatively brittle, and its purpose consists primarily in holding in the predetermined position the granular material 8 in the initial state of the sleeve 3.

In the embodiment shown, the inner face 11 of the intermediate layer 4 is symmetrical to the central axis 10 of the sleeve 3 and has a shape adapted to the cross-section of the reinforcing element or reinforcing elements 1 to be inserted such that the reinforcing element or reinforcing elements 1 may with the necessary clearance of movement be inserted into the intermediate layer 4. In the embodiment shown, three reinforcing elements 1 in the form of strands are provided which are made into cables from seven drawn wires 12 of equal cross-section while in the cross-section through each reinforcing element 1, there are provided a core wire and six outer wires distributed uniformly over its periphery. The inner face 11 of the intermediate layer 4 forms for each reinforcing element 1 a separate recess almost cylindrical in cross-section. The three recesses are distributed uniformly around the central axis of the intermediate layer 4 and are open in cross-section to this central axis in such a way that between adjacent recesses, projections 13 are formed in the intermediate layer 4 which projections project in cross-section towards the central axis 10 and in the region of which the intermediate layer 4 has its greatest thickness. Into the recesses extending over the whole length of the intermediate layer 4 there are introduced the ends 2 of the reinforcing elements 1, consisting of for example steel (shown in broken line).

Thereupon, the sleeve 3 is cold formed by applying radial forces to the cylindrical outer periphery 14 of sleeve 3 by means of a swaging press 15 shown in broken lines in FIG. 1. This may be effected for example step-wise starting from one end of the sleeve 3 in longitudinal sections which are shorter than the total length of the sleeve. With this cold forming in which the outer and inner diameters of the sleeve 3 according to FIGS. 1 and 3 are reduced approximately uniformly over the whole periphery, the intermediate layer 4 is pressed over the periphery and in its longitudinal direction uniformly against the ends 2 of the reinforcing elements 1 while the granules of the granular material 8 are moved against one another and finally projecting from the binding 9 are stamped into the surface of the ends 2 as well as also the inner face 4 of the sleeve 3. The intermediate layer 4 then fills all hollow spaces between the ends 2 of the reinforcing elements 1 and the inner face 5 of the sleeve 3 so that the reinforcing elements 1 are positively connected to the sleeve 3. Since the recesses for the ends 2 of the reinforcing elements 1 in the intermediate layer 4 are open towards the central axis 10, the ends 2 of the reinforcing elements 1 during the cold shaping of the sleeve 3 engage each other while, however, the projections 13 of the intermediate layer 4 extend as far as directly adjacent to the contact faces. If the intermediate layer is so formed that parts thereof also lie between the reinforcing elements and their ends 2, these ends will also after the cold forming not directly contact each other but in this case each reinforcing element is completely surrounded by the intermediate layer 4.

The granules of the granular material 8 may be sharp edged so that they press in a particularly secure holding manner into the reinforcing element and the sleeve. They may however also be round so that the notch action on the impressions is particularly light. Furthermore, it is possible to provide a mixture of sharp edged and round granules or a mixture of granules of different shape and/or size and thereby form the intermediate layer to the actual requirements. A particularly advanatageous construction consists in so to step or grade the granules of the granular material 8 towards the end 6 of the sleeve 3 from which the stressed section of the reinforced element 1 is led away, that the granule size decreases toward this end so that also damages due to the impressing of the granules in the surface of the reinforcing element become negligibly small. In view of such minor decrease in strength by damage to the surface of the reinforcing element, it is furthermore possible, in the region of the said end of the intermediate layer 4, to provide round granules or to select such an arrangement that the shape of the granules toward this end is in steps graduated to a more round shape from a sharp edged shape or such that there is a mixture having a portion of round granules which in comparison with the portion of sharp edged granules decreases toward this end. A further possibility consists in providing in the region of the inner face of the intermediate layer 4 more round granules than in the region of the outer face associated with the inner face 5 of the sleeve 3.

The anchoring arrangement according to the invention is not only suitable for round reinforcing elements but also for reinforcing elements of any desired cross-section, in particular for cables according to FIGS. 1 to 3, because the intermediate layer 4 after the cold shaping contacts almost over its entire surface the periphery of the reinforcing element.

While in the embodiment according to FIGS. 1 to 3 the granular material 8 may be cemented by a binding 9 of comparatively brittle material, the binding 9*a* of the intermediate layer 4*a* according to FIGS. 4 and 5 consists of a flexible material, preferably a permanently elastic material such as plastics, so that the intermediate layer 4*a* may be made as an approximately plane development of the form of use. The upper face 15 of the intermediate layer 4*a* provided for engagement with the inner face of the sleeve is formed plane and smooth whereas the other face 11*a* corresponding to the reinforcing elements to be inserted has e.g. a horizontal corrugated profile provided with projections 13*a*. This intermediate member 4*a*, which may be formed for example in the shape of a section of a profiled rope, is inserted into the sleeve, after being conveyed into a round form according to FIG. 5 in which its side edges nearly abut each other. In particular with an elastic construction of the intermediate member 4 or 4*a* it is also possible prior to inserting the intermediate member into the sleeve, to arrange the intermediate member around the reinforcing elements and to envelop the reinforcing elements in the intermediate member and then to push them into the sleeve.

FIGS. 6 and 7 illustrate an anchoring system according to the invention for interconnecting two reinforcing elements arranged one behind the other or bundles of reinforcing elements the ends 2*b*, 2*c* of which nearly abut each other in the sleeve 3*b*. One reinforcing element or bundle of reinforcing elements is formed by strands 1*b* whereas the reinforcing element 1*c* extending out of the other end of the sleeve 3*b* is formed by a bundle of wires of for example circular equal cross-sections the ends 2*a* of which lying in the sleeve 3*b* are arranged around a round smooth filling rod 18 which is located completely inside the sleeve 3*b* or an intermediate layer 4*b* and expediently is formed cylindrically in such a way that adjacent ends 2*c* contact each other.

The intermediate layer 4*b* reaching approximately over the entire length of the sleeve 3*b* having a constant cross-section has two sections 16, 17 which have different inner cross-sections and are located behind the other in longitudinal direction. The inner cross-section of the respective section 16, 17 is adapted to the ends 2*b* and 2*c* respectively of the pertaining reinforcing element 1*b* and 1*c*. The intermediate layer 4*b* is expediently formed over the entire length of the sleeve 3*b* by means of an uninterrupted continuous structural element but may also be formed, in particular with the design of FIGS. 4 and 5, by two separate intermediate member sections arranged one behind the other. After sleeve 3*b* has been cold shaped, the ends 2*b*, 2*c* of all reinforcing elements 1*b*, 1*c* are securely anchored in the manner described. Granular material is not necessary between the ends 2*c* of the wires and the filling rod 18.

In the embodiment according to FIG. 8, intermediate layer 4*d* extends only over a part of sleeve 3*d* namely approximately over half of the length of the sleeve 3*b* while the intermediate member 4*d* extends approximately up to one end 6*d* of the sleeve 3*d* and serves for the anchoring of the ends 2*d* of a reinforcing element 1*d* formed for example by several strands. In the region of the intermediate layer 4*d*, the sleeve 3*d* is formed as a first longitudinal section 16*d* which is followed by a second longitudinal section 17*d* extending up to the other end 7*d* and formed in one piece with a longitudinal section 16*d*. In the initial state of the sleeve 3*d* said section 17*d* may have the same inner cross-section as well as the same outer cross-section as the longitudinal section 16*d*. The end 2*e* of a profiled rod 1*e*, e.g. a horizontal threaded rod, is inserted into the longitudinal section 17*d* and by radial cold shaping the sleeve 3*d* and the longitudinal section 17*b* is positively connected to the sleeve while the profiling on the outer periphery of the end 2*e* is impressed into the inner face 5*e* on the longitudinal section 17*b* so that granular material is not necessary.

It is, of course, to be understood that the present invention is, by no means, limited to the specific showing in the drawing but also comprises any modifications within the scope of the appended claims.

What I claim is:

1. An anchoring arrangement, especially for prestressed concrete constructions, for the anchoring of reinforcing means in the form of ropes, cables, wires and rods, which includes in combination: an outer sleeve of cold-compressible deformable soft steel, a prefabricated intermediate layer, arranged within and in contact with said outer sleeve, said prefabricated intermediate layer consisting of hard steel granular material with the granules of hard steel thereof densely arranged therewith and also consisting of a binding substance for said hard steel granules embedded therein, said prefabricated intermediate layer defining a hollow central space extending in the axial direction of said outer sleeve, and reinforcing means arranged within and substantially filling said hollow space while being in tight radially compressed engagement with said prefabricated intermediate layer, the granules of said prefabricated intermediate layer being harder than said reinforcing means and said sleeve and originally having at least substantially the form of the central hollow space between said outer sleeve and said reinforcing means, said hard steel granules during deformation of said outer sleeve pressing into said reinforcing means and said sleeve, said granules substantially filling the space between said reinforcing means and sleeve and in contact with each other through said space with the binding substance in the interstices between the particles, whereby the granules transfer the force directly from the reinforcing means to the sleeve.

2. An arrangement in combination according to claim 1, in which the granules of said intermediate layer at least within the inner region of said layer decrease in size toward one end of said sleeve.

3. An arrangement in combination according to claim 1, in which said binding substance consists of a form-retaining substance.

4. An arrangement in combination according to claim 1, in which said binding substance with the granular material embedded therein consists of a pre-shaped structure adapted to be curved in conformity with the inner contour of said sleeve and insertable thereinto.

5. An arrangement in combination according to claim 1, in which said reinforcing means includes two of said of said reinforcing units which are located within said intermediate layer and are connected by the latter to said sleeve means.

* * * * *